US006089692A

United States Patent [19]

Anagnostopoulos

[11] Patent Number: 6,089,692

[45] Date of Patent: Jul. 18, 2000

[54] INK JET PRINTING WITH MULTIPLE DROPS AT PIXEL LOCATIONS FOR GRAY SCALE

[75] Inventor: Constantine N. Anagnostopoulos, Mendon, N.Y.

[73] Assignee: Eastman Kodak Company, Rochester, N.Y.

[21] Appl. No.: 08/907,610

[22] Filed: Aug. 8, 1997

[51] Int. Cl.[7] ..... B41J 2/205

[52] U.S. Cl. ..... 347/15; 347/9; 347/37

[58] Field of Search ..... 347/12, 13, 15, 347/43, 37; 358/298

[56] References Cited

U.S. PATENT DOCUMENTS

| | | | |
|---|---|---|---|
| 3,946,398 | 3/1976 | Kyser et al. | 347/70 |
| 4,065,773 | 12/1977 | Berry | 347/15 |
| 4,166,277 | 8/1979 | Cielo et al. | 347/55 |
| 4,275,290 | 6/1981 | Cielo et al. | 347/61 |
| 4,412,225 | 10/1983 | Yoshida et al. | 347/43 |
| 4,490,728 | 12/1984 | Vaught et al. | 347/60 |
| 4,728,968 | 3/1988 | Hillman et al. | 347/43 |
| 4,751,531 | 6/1988 | Saito et al. | 347/55 |
| 4,967,203 | 10/1990 | Doan et al. | 347/41 |
| 4,999,646 | 3/1991 | Trask | 347/41 |
| 5,012,257 | 4/1991 | Lowe et al. | 347/43 |
| 5,111,302 | 5/1992 | Chan et al. | 358/298 |
| 5,252,986 | 10/1993 | Takaoka et al. | 347/15 |
| 5,384,587 | 1/1995 | Takagi et al. | 347/41 |
| 5,485,180 | 1/1996 | Askeland et al. | 347/15 |
| 5,617,123 | 4/1997 | Takaoka et al. | 347/15 |
| 5,805,178 | 9/1998 | Silverbrook | 347/15 |

FOREIGN PATENT DOCUMENTS 2 007 162 10/1978 United Kingdom .

*Primary Examiner*—N. Le
*Assistant Examiner*—Craig A. Hallacher
*Attorney, Agent, or Firm*—Milton S. Sales

[57] ABSTRACT

An ink jet printing apparatus is disclosed for producing gray scale image pixels on a received recording medium includes a plurality of electrical pulse activated ink-ejecting nozzles forming a one-dimensional array in a first direction. A plurality of nozzle control circuits apply electrical pulses to selected nozzles of the array so that each selected nozzle will deposit ink droplets on a received recording medium. A transport mechanism provides relative movement between the nozzle array and the medium in a second direction generally normal to the first direction. A transport mechanism control system provides intermittent relative movement between the nozzle array and the medium, and repeatedly pauses the relative movement while a plurality of droplets are selectively deposited by each nozzle of the array, whereby a pixel is formed having a gray scale level equal to the number of nozzles in the array multiplied by the number of pauses multiplied by the number of droplets that are selectively deposited by each nozzle during each pause, including zero droplets.

6 Claims, 8 Drawing Sheets

INK JET PRINTING WITH MULTIPLE DROPS AT PIXEL LOCATIONS FOR GRAY SCALE

CROSS REFERENCE TO RELATED APPLICATIONS

Reference is made to commonly assigned co-pending U.S. patent applications Ser. No. 08/750,438 entitled A LIQUID INK PRINTING APPARATUS AND SYSTEM filed in the name of Kia Silverbrook on Dec. 3, 1996, and Ser. No. 08/777,133 INK COMPOSITION CONTAINING SURFACTANT SOLS COMPRISING MIXTURES OF SOLID SURFACTANTS filed in the name of P. Bagchi et al. on Dec. 30, 1996.

FIELD OF THE INVENTION

This invention relates generally to the field of digitally controlled ink transfer printing devices, and in particular to liquid ink drop-on-demand printheads which are capable of selectively building up layers of ink at each pixel position.

BACKGROUND OF THE INVENTION

Ink jet printing has become recognized as a prominent contender in the digitally controlled, electronic printing arena because, for example, of its non-impact, low-noise characteristics, its use of plain paper and its avoidance of toner transfers and fixing. Ink jet printing mechanisms can be categorized as either continuous ink jet or drop-on-demand ink jet. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Other types of piezoelectric drop-on-demand printers utilize piezoelectric crystals in push mode, shear mode, and squeeze mode. Piezoelectric drop-on-demand printers have achieved commercial success at image resolutions up to 720 dpi for home and office printers.

Great Britain Pat. No. 2,007,162, which issued to Endo et al. in 1979, discloses an electrothermal drop-on-demand ink jet printer which applies a power pulse to an electrothermal heater which is in thermal contact with water based ink in a nozzle. A small quantity of ink rapidly evaporates, forming bubbles which cause drops of ink to be ejected from small apertures along the edge of the heater substrate. This technology is known as Bubblejet™ (trademark of Canon K.K. of Japan).

U.S. Pat. No. 4,490,728, which issued to Vaught et al. in 1982, discloses an electrothermal drop ejection system which also operates by bubble formation to eject drops in a direction normal to the plane of the heater substrate. As used herein, the term "thermal ink jet" is used to refer to both this system and system commonly known as Bubblejet™.

U.S. Pat. No. 4,275,290, which issued to Cielo et al., discloses a liquid ink printing system in which ink is supplied to a reservoir at a predetermined pressure and retained in orifices by surface tension until the surface tension is reduced by heat from an electrically energized resistive heater, which causes ink to issue from the orifice and to thereby contact a paper receiver.

U.S. Pat. No. 4,166,277, which also issued to Cielo et al., discloses a related liquid ink printing system in which ink is supplied to a reservoir at a predetermined pressure and retained in orifices by surface tension. The surface tension is overcome by the electrostatic force produced by a voltage applied to one or more electrodes which lie in an array above the ink orifices, causing ink to be ejected from selected orifices and to contact a paper receiver.

In U.S. Pat. No. 4,751,531, which issued to Saito, a heater is located below the meniscus of ink contained between two opposing walls. The heater causes, in conjunction with an electrostatic field applied by an electrode located near the heater, the ejection of an ink drop. There are a plurality of heater/electrode pairs, but there is no orifice array. The force on the ink causing drop ejection is produced by the electric field, but this force is alone insufficient to cause drop ejection. That is, the heat from the heater is also required to reduce either the viscous drag and/or the surface tension of the ink in the vicinity of the heater before the electric field force is sufficient to cause drop ejection.

Commonly assigned U.S. patent application Ser. No. 08750,438 entitled A LIQUID INK PRINTING APPARATUS AND SYSTEM filed in the name of Kia Silverbrook on Dec. 3, 1996, discloses a drop-on-demand printing mechanism wherein the means of selecting drops to be printed produces a difference in position between selected drops and drops which are not selected, but which is insufficient to cause the ink drops to overcome the ink surface tension and separate from the body of ink, and wherein an additional means is provided to cause separation of said selected drops from said body of ink. Several drop separation techniques for discriminating between selected drops and un-selected drops are disclosed by Silverbrook, including electrostatic attraction, an AC electric field, proximity (printhead is in close proximity to, but not touching, recording medium), transfer proximity (print-head is in close proximity to a transfer roller or belt), proximity with oscillating ink pressure, and magnetic attraction.

DISCLOSURE OF THE INVENTION

It is an object of the present invention to provide a fast, inexpensive ink jet printing system capable of producing photographic quality images having a resolution in the order of six line pairs/mm and a dynamic range of about 128 levels of gray scale.

According to a feature of the present invention, a process is provided for producing gray scale image pixels from a one-dimensional array of electrical pulse-activated ink jet nozzles generally aligned in a first direction; the process including the steps of applying electrical pulses to selected nozzles of the array so that each selected nozzle will deposit ink droplets on a recording medium, inducing intermittent relative movement between the nozzle array and the medium in a second direction generally normal to the first direction, and controlling the relative movement between the nozzle array and the medium to repeatedly pause the relative movement while a plurality of droplets are selectively deposited by each nozzle of the array, whereby a pixel is formed having a gray scale level equal to the number of nozzles in the array multiplied by the number of pauses multiplied by the number of droplets that are selectively deposited by each nozzle during each pause, including zero droplets.

According to another feature of the present invention, an ink jet printing apparatus for producing gray scale image pixels on a received recording medium includes a plurality of electrical pulse activated ink-ejecting nozzles forming a one-dimensional array in a first direction. A plurality of nozzle control circuits apply electrical pulses to selected nozzles of the array so that each selected nozzle will deposit ink droplets on a received recording medium. A transport mechanism provides relative movement between the nozzle array and the medium in a second direction generally normal to the first direction. A transport mechanism control system provides intermittent relative movement between the nozzle array and the medium, and repeatedly pauses the relative movement while a plurality of droplets are selectively deposited by each nozzle of the array, whereby a pixel is formed having a gray scale level equal to the number of nozzles in the array multiplied by the number of pauses multiplied by the number of droplets that are selectively deposited by each nozzle during each pause, including zero droplets.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 1(*b*) is a cross sectional view of a nozzle tip usable in the present invention;

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

The present invention is described in conjunction with the liquid ink printing apparatus and system described in the above-mentioned Silverbrook patent application Ser. No. 08/750,438; but it will be appreciated by those skilled in the art that there are other ink jet printing systems that are suitable for use with the invention.

Figures 1A, 1B:
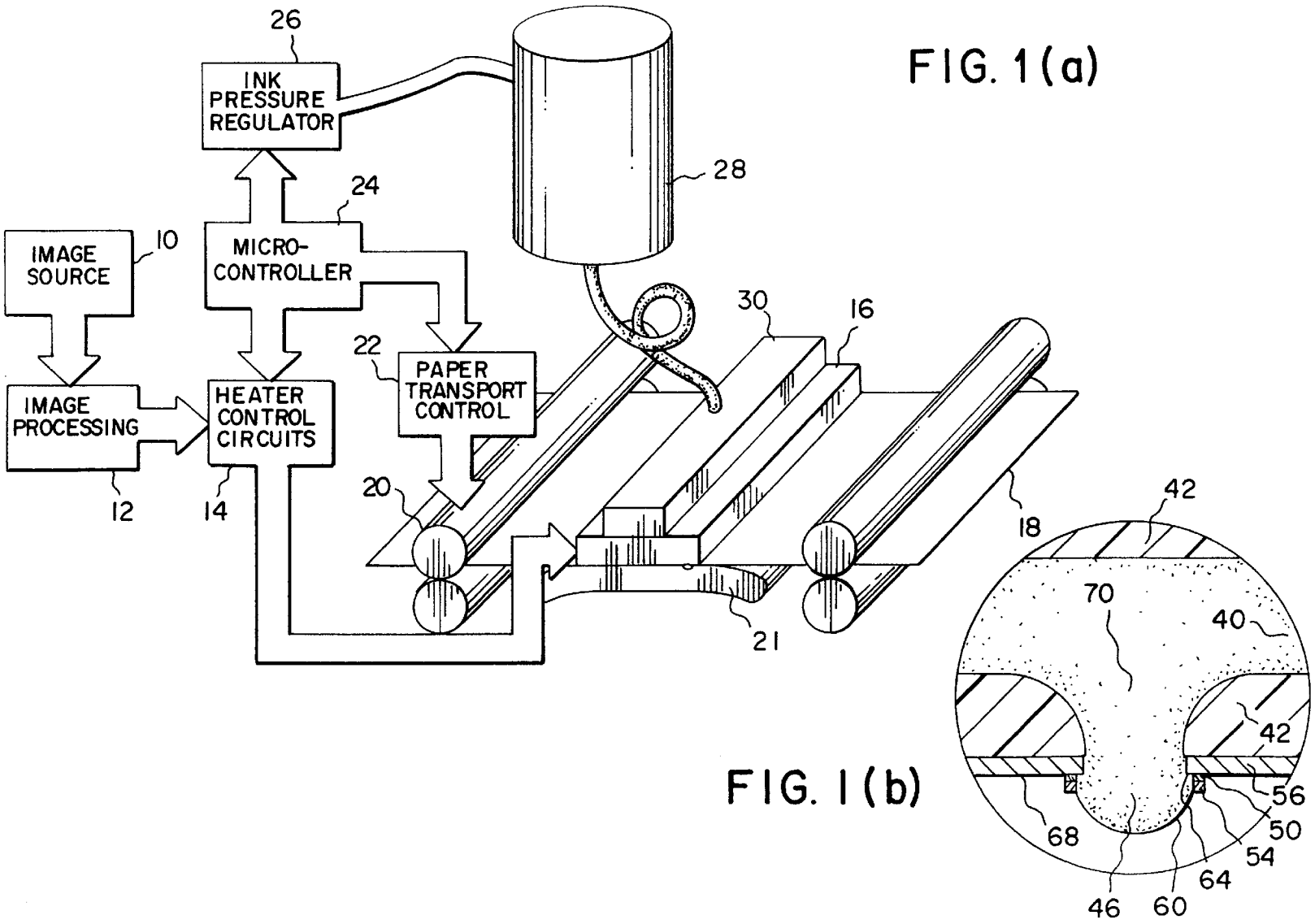
FIG. 1(*a*) shows a simplified block schematic diagram of one exemplary printing apparatus according to the present invention.

FIG. 1(*a*) is a drawing of an ink transfer system utilizing a printhead which is capable of producing a drop of controlled volume. An image source 10 may be raster image data from a scanner or computer, or outline image data in the form of a page description language, or other forms of digital image representation. This image data is converted by an image processing unit 12 to a map of the thermal activation necessary to provide the proper volume of ink for each pixel. This map is then transferred to image memory. Heater control circuits 14 read data from the image memory and in conjunction with the on-chip scanners and drivers apply time-varying or multiple electrical pulses to selected nozzle heaters that are part of a printhead 16. These pulses are applied for an appropriate time, and to the appropriate nozzle, so that selected drops with controlled volumes of ink will form spots on a recording medium 18 after transfer in the appropriate position as defined by the data in the image memory. Recording medium 18 is moved relative to printhead 16 by a paper transport roller 20, which is electronically controlled by a paper transport control system 22, which in turn is controlled by a micro-controller 24.

Micro-controller 24 also controls an ink pressure regulator 26, which maintains a constant ink pressure in an ink reservoir 28 for supply to the printhead through an ink channel assembly 30. Ink channel assembly 30 may also serve the function of holding the printhead rigidly in place, and of correcting warp in the printhead. Alternatively, for larger printing systems, the ink pressure can be very accurately generated and controlled by situating the top surface of the ink in reservoir 28 an appropriate distance above printhead 16. This ink level can be regulated by a simple float valve (not shown). The ink is distributed to the back surface of printhead 16 by an ink channel device 30. The ink preferably flows through slots and/or holes etched through the silicon substrate of printhead 16 to the front surface, where the nozzles and heaters are situated.

FIG. 1(*b*) is a detail enlargement of a cross-sectional view of a single nozzle tip of the drop-on-demand ink jet printhead 16. An ink delivery channel 40, along with a plurality of nozzle bores 46 are etched in a substrate 42, which is silicon in this example. In one example the delivery channel 40 and nozzle bore 46 were formed by anisotropic wet etching of silicon, using a $p^+$ etch stop layer to form the shape of nozzle bore 46. Ink 70 in delivery channel 40 is pressurized above atmospheric pressure, and forms a meniscus 60 which protrudes somewhat above nozzle rim 54, at a point where the force of surface tension, which tends to hold the drop in, balances the force of the ink pressure, which tends to push the drop out.

In this example, the nozzle is of cylindrical form, with a heater 50 forming an annulus. In this example the heater was made of polysilicon doped at a level of about thirty ohms/square, although other resistive heater material could be used. Nozzle rim 54 is formed on top of heater 50 to provide a contact point for meniscus 60. The width of the nozzle rim in this example was 0.6 $\mu$m to 0.8 $\mu$m. Heater 50 is separated from substrate 42 by thermal and electrical insulating layers 56 to minimize heat loss to the substrate.

The layers in contact with the ink can be passivated with a thin film layer 64 for protection, and can also include a layer to improve wetting of the nozzle with the ink in order to improve refill time. The printhead surface can be coated with a hydrophobizing layer 68 to prevent accidental spread of the ink across the front of the printhead. The top of nozzle rim 54 may also be coated with a protective layer which could be either hydrophobic or hydrophillic.

In the quiescent state (with no ink drop selected), the ink pressure is insufficient to overcome the ink surface tension and eject a drop. The ink pressure for optimal operation will depend mainly on the nozzle diameter, surface properties (such as the degree of hydrophobicity) of the nozzle bore 46 and the rim 54 of the nozzle, surface tension of the ink, and the power and temporal profile of the heater pulse.

The ink surface tension decreases with temperature such that heat transferred from the heater to the ink after application of an electrothermal pulse will result in the expansion of poised meniscus 60. In addition, it is desirable that the ink have the ability to remain expanded at a fixed volume for a time after the electrothermal pulse has terminated. Such an ink exhibiting this property contains surfactant sols comprising mixtures of solid surfactants such as carboxylic acids. Commonly assigned U.S. patent application Ser. No. 08/777,133 INK COMPOSITION CONTAINING SURFACTANT SOLS COMPRISING MIXTURES OF SOLID SURFACTANTS filed in the name of P. Bagchi et al. on Dec. 30, 1996, discloses such an ink composition. The disclosure of the Bagchi et al. application is hereby specifically incorporated by reference into the present disclosure.

Figure 2:
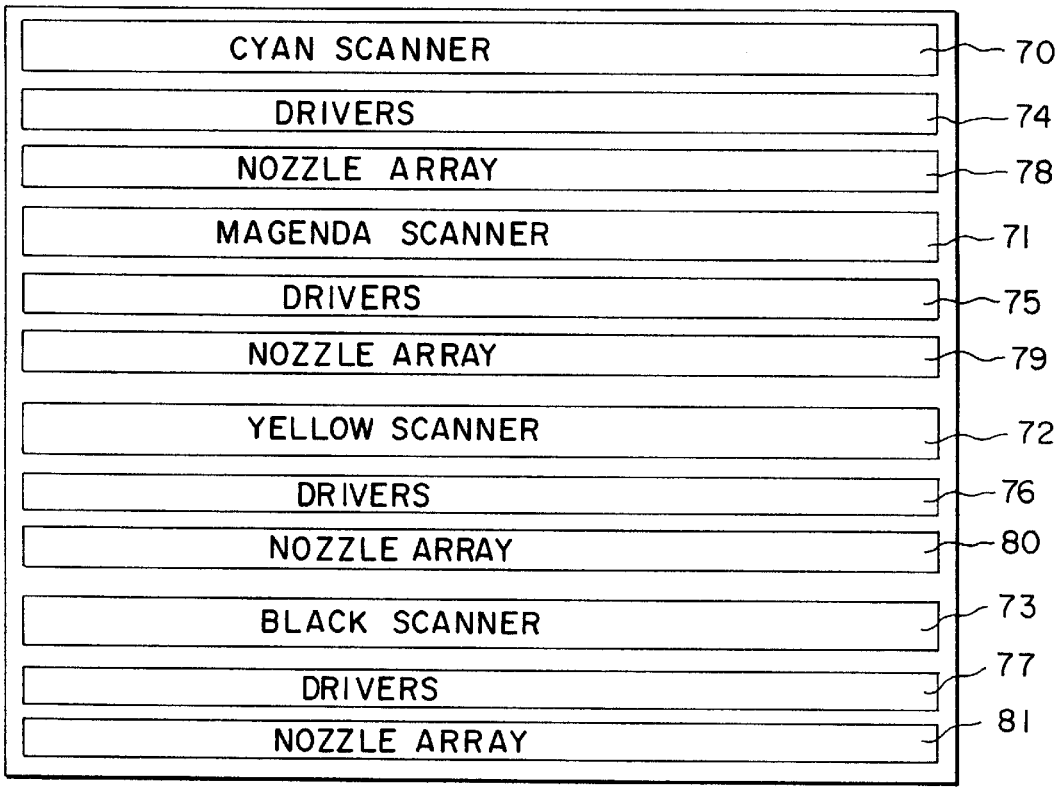
FIG. 2 is a view of the printhead architecture, showing one of ten sub-arrays, wherein each sub-array is constructed of four color channels, and each color channel includes a plurality of nozzle elements.

Referring to FIG. 2, a printhead according to a preferred embodiment of the present invention includes a cyan scanner array 70, a magenta scanner array 71, a yellow scanner array 72, and a black scanner array 73. Driver arrays 74–77 and nozzle arrays 78–81 are associated with scanner arrays 70–73, respectively. Typically, a printhead consists of a number of nozzle sub-arrays, each containing 512 nozzles. Each sub-array has its own 512 stage scanner and 512 drivers. Each scanner sub-array has its own clocks, data input, and power connections and each driver sub-array has, similarly, its own power and ground connections and clocks.

Figure 3:
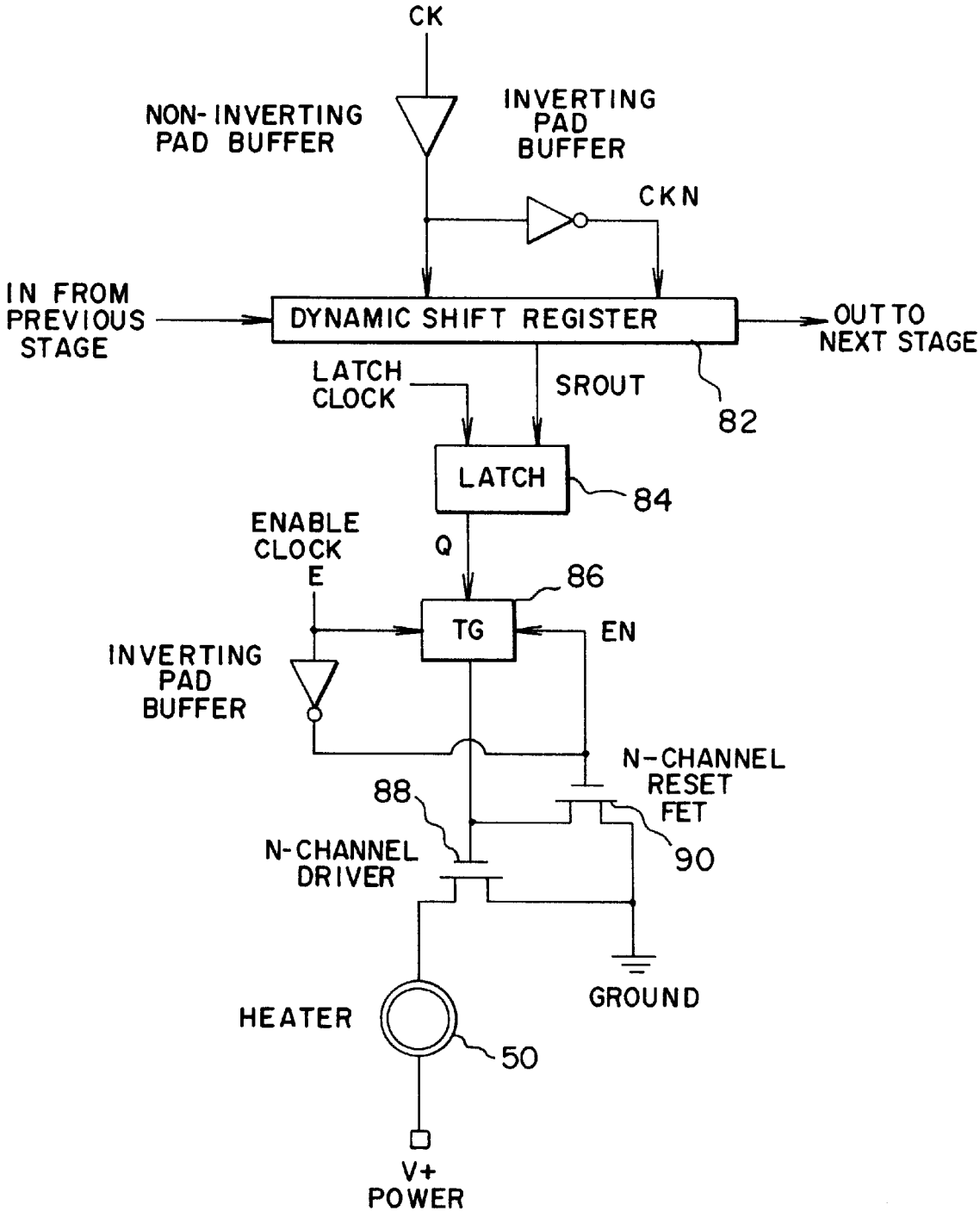
FIG. 3 illustrates the preferred configuration of each of a plurality of scanner and driver circuits.

FIG. 3 illustrates the preferred electrical circuit configuration of a single slice of a scanner and driver array. The circuit consists of a dynamic shift register 82, a D-type latch 84, a transmission gate 86, an n-channel driver field effect transistor (FET) 88, and an n-channel reset FET 90. Heater 50 is illustrated as a toroid in FIG. 3, although the electrical equivalent of a heater is a resistor. The combination of transmission gate 86 along with driver FET 88 and reset FET 90 behave as a logic AND gate.

Operation of the circuit of FIG. 3 is as follows: data consisting of either a ONE or a ZERO is loaded into shift register 82. A clock is applied to latch 84, and the data is transferred from the shift register to the output Q of the latch, whereat the data remains valid for as long as the latch clock remains LOW. Now, the data in shift register 82 can change to the next value without affecting the value at Q. An enable clock signal E is applied to transmission gate 86 to propagate the value at Q to the gate of driver FET 88. If the value at Q is HIGH, the driver FET turns ON and current flows through heater 50. If the value at Q is LOW, the heater draws no current. Enable clock E remains ON for a predetermined amount of time, which is the time required for the ink to be heated sufficiently for a droplet to grow beyond its quiescent position. Then enable clock E turns OFF. However, its inverse clock EN goes high, which turns ON reset FET 90. The reset FET connects the gate of driver FET 88 to ground, turning it OFF and stopping the current through heater 50.

The preferred process for fabrication of nozzle 50 is compatible with either a CMOS or a BiCMOS technology, so that the addressing and driving electronics can be integrated alongside of the nozzles on the same silicon substrate. The fabrication sequence is described with reference to FIGS. 4–6.

Figure 4:
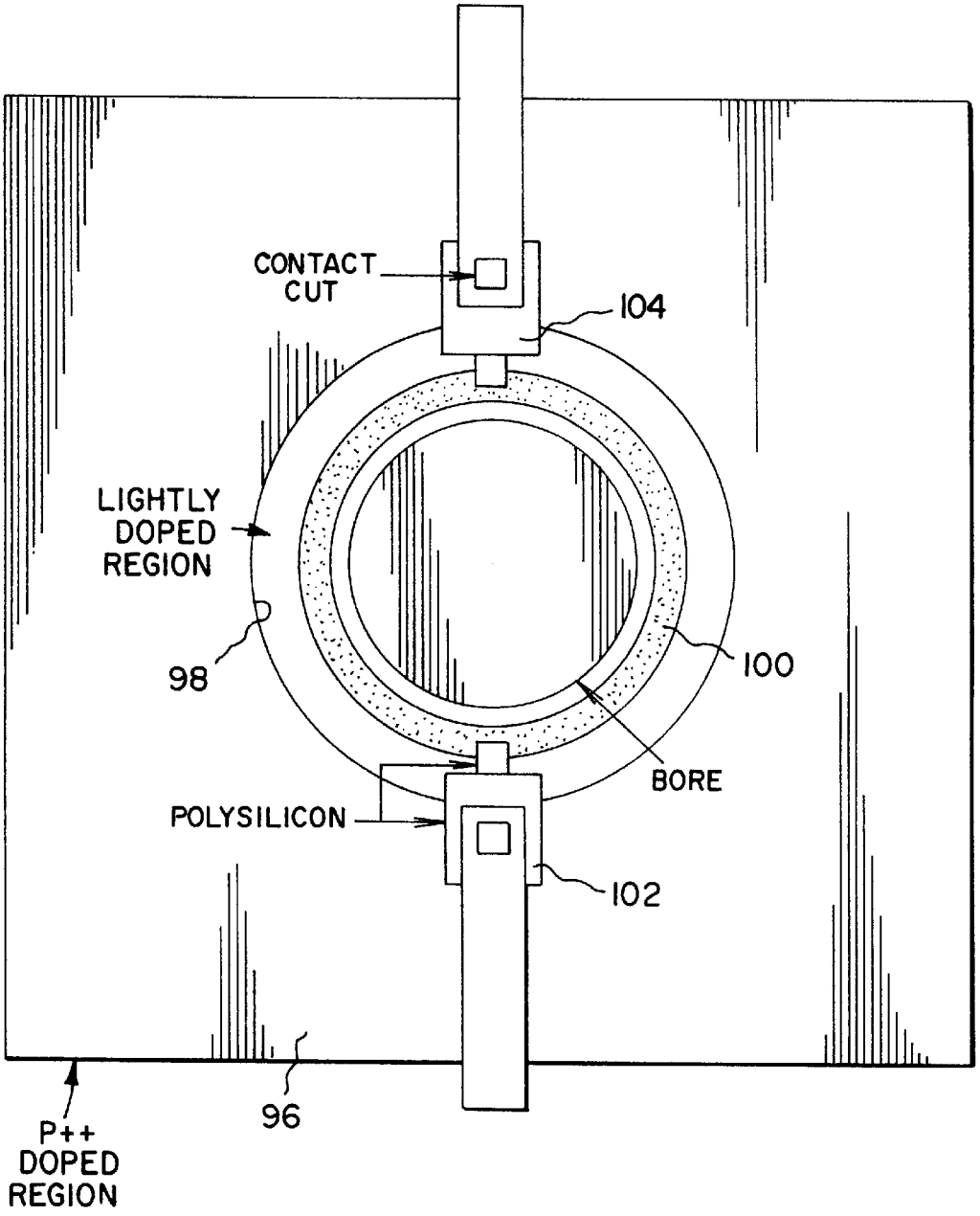
FIG. 4 shows a top view of a single nozzle.

The process starts by implanting heavily with boron at a level of about 1E17 cm--2, rectangular regions 96 in the front side of the wafers, as shown in FIG. 4, leaving the region within inner circular edge 98 undoped. These undoped circular regions eventually become the nozzle orifice. Next, a 2000 Å thick layer of silicon dioxide is deposited and the wafers are placed in a 1200° C. furnace to drive in the boron such that the boron concentration is higher than about 1E19 cm−3 for a depth of at least 5 $\mu$m. A layer of about 2300 Å of silicon nitride is deposited, followed by a layer of about 5000 Å of silicon dioxide and a layer of about 4000 Å of polysilicon. The polysilicon layer is then doped with phosphorous to a sheet resistance of about 30 ohms per square. Finally, another layer of about 5000 Å of silicon dioxide is deposited.

Next, a rim mask is applied to define a toroid 100 as shown in FIG. 4. The 5000 Å oxide is then etched off from everywhere else. The polysilicon mask is then applied. All polysilicon is then etched off except for polysilicon tabs 102 and 104 indicated in FIG. 4 and the polysilicon beneath the oxide rim 100. The tabs provide the electrical connection to the toroidal heater, which resides beneath the oxide rim to which it is self aligned. At this point, a 500 Å silicon nitride layer is deposited everywhere on top of the wafer. The contact mask then defines the two small rectangles indicated in FIG. 4 from where the silicon nitride is removed. A layer of about 8000 Å of aluminum is deposited next, and is defined by the metal mask in the conductor pattern shown in FIG. 4. The bore mask is then applied, and all the oxide and nitride layers are removed from the bore region.

Figure 5A:
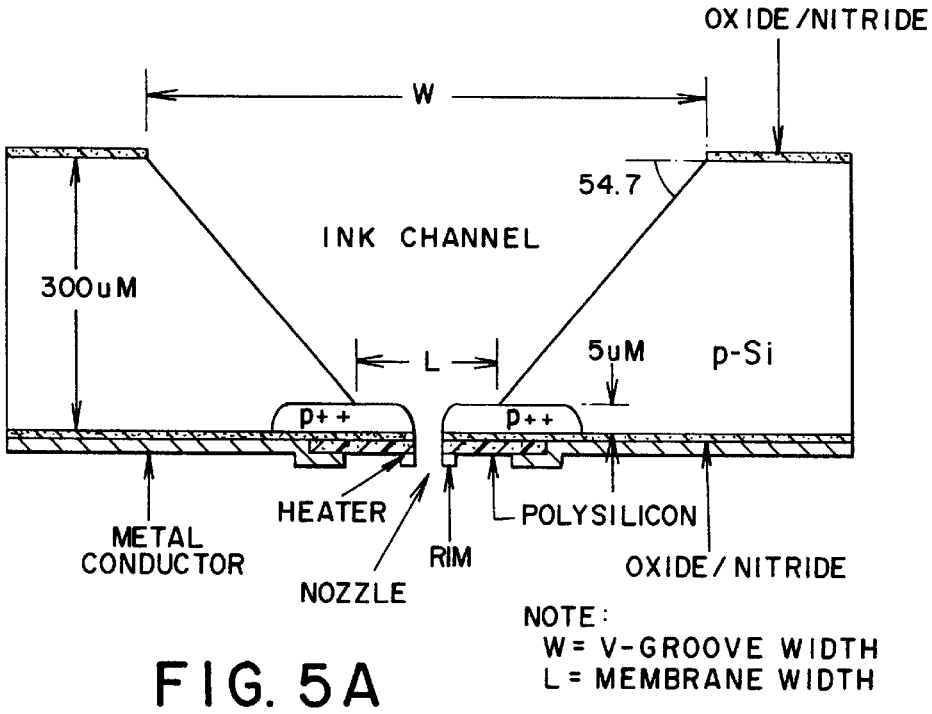
FIG. 5A is a cross sectional view of a wet etched nozzle and ink channel.
Figure 5B:
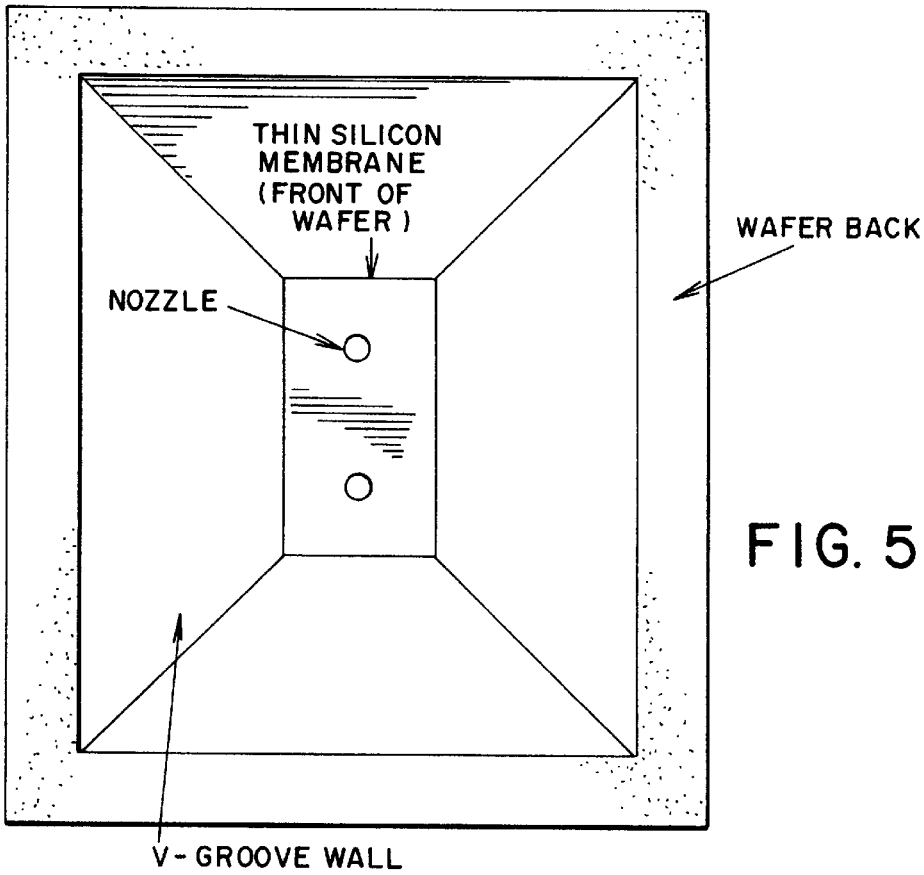
FIG. 5B is a back view of the wet etched nozzle and ink channel of FIG. 5A.
Figure 5C:
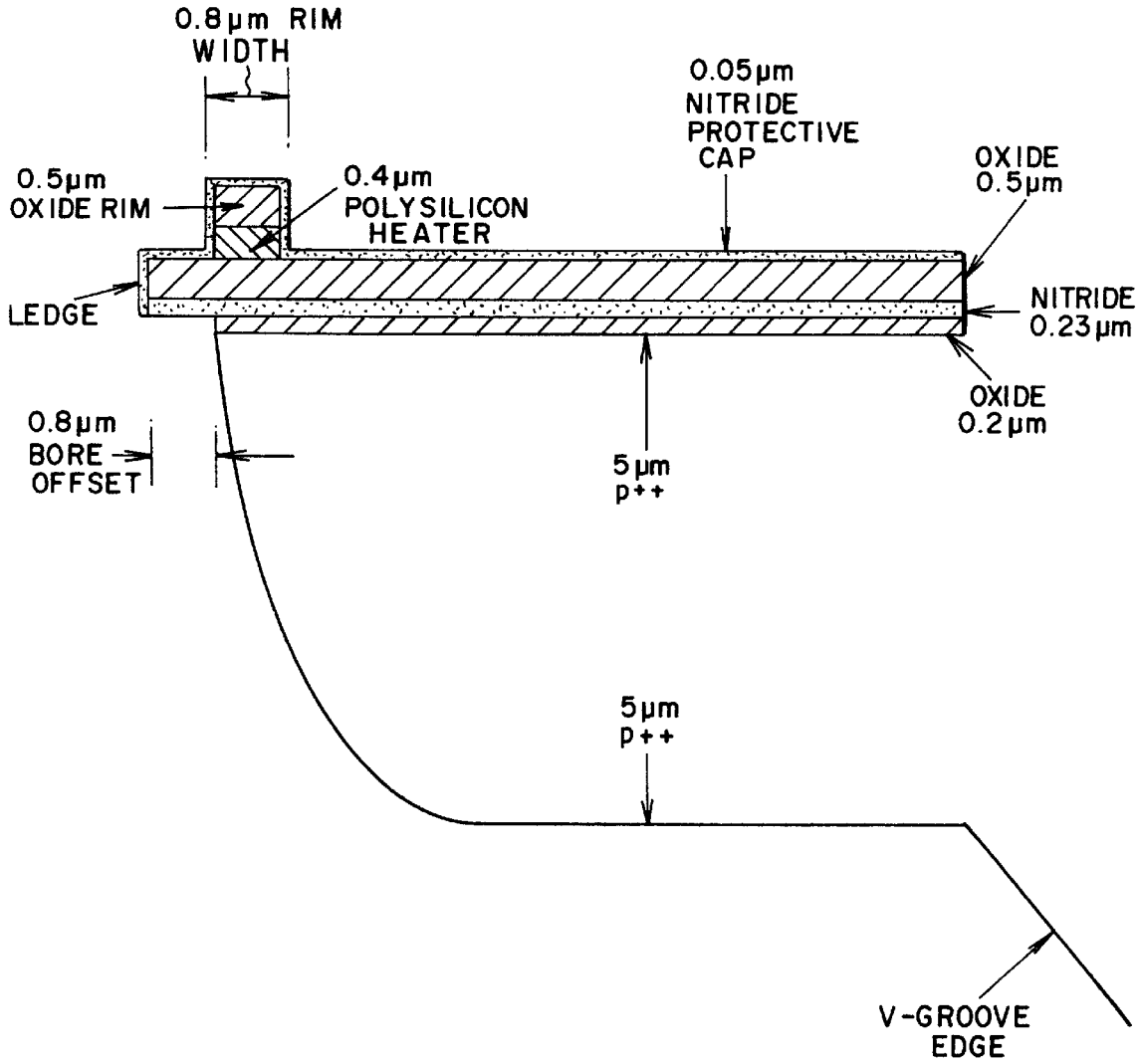
FIG. 5C is a detail edge view of the nozzle of FIGS. 5A and 5B.

The final mask is now applied to the back of the wafers to define rectangles that are in alignment with the heavily doped boron regions in front of the wafers; as described in "Mask Aligners" product literature published by Karl Suss, Inc. of Waterbury Center, Vt. 05677, USA. This mask is used to remove the silicon nitride, deposited on the back of the wafers earlier, from the areas of the rectangles defined in back of the wafers. The wafers are then placed in a KOH bath. This etchant, as described by Lj Ristic, H. Hughes and F. Shemansky in "Bulk Micromachining Technology" in *Sensor Technology and Devices*, Ljubisa Ristic Ed., Ch. 3, Boston: Artech House Inc., 1994, and by S. J. Tanghe and K. D. Wise in "A 16-channel CMOS Neural Simulating Array" in IEEE Journal of Solid State Circuits, Vol. 27, pp 1819–1825, Dec. 1992. The etchant etches the <100> planes but not the <111> planes. A V-groove then forms starting from the back of the wafer and proceeding to the front. The etchant does not etch silicon that is doped heavily with boron. The resultant channel is shown in FIG. 5A. Recall that the heavily doped boron regions in the fronts of the wafers had annular regions that were left undoped. The etchant proceeds through them, punching through to the front surface of the wafer. The undoped annular regions in FIG. 4 shrink in size because of the sideways diffusion of boron during the about 1200 degree drive-in step. A more detailed cross sectional view of the nozzle is shown in FIG. 5C. FIG. 5B shows a pair of adjacent nozzles as viewed from the back of the wafer.

Finally, the wafers are diced and the individual die are mounted into appropriate carriers and wire bonded. The packages used for the die have holes drilled through them so that ink can be supplied from the outside to the V-groove channels. The ink is pressurized slightly so that a meniscus is formed at each nozzle. If a data ONE is loaded into the shift register stage corresponding to a given nozzle, the driver is activated when the enable clock is applied; and current flows through the polysilicon toroidal heating element. For a 16 $\mu$m diameter nozzle, the heater resistance is about 500 ohms. When connected to a 5 volt supply via the driver, a current of about 10 mA flows. This current applied for about 20 μs delivers about 1000 E-9 Joules of energy, which is enough to induce continuous and irreversible dropplet growth.

Figure 6:
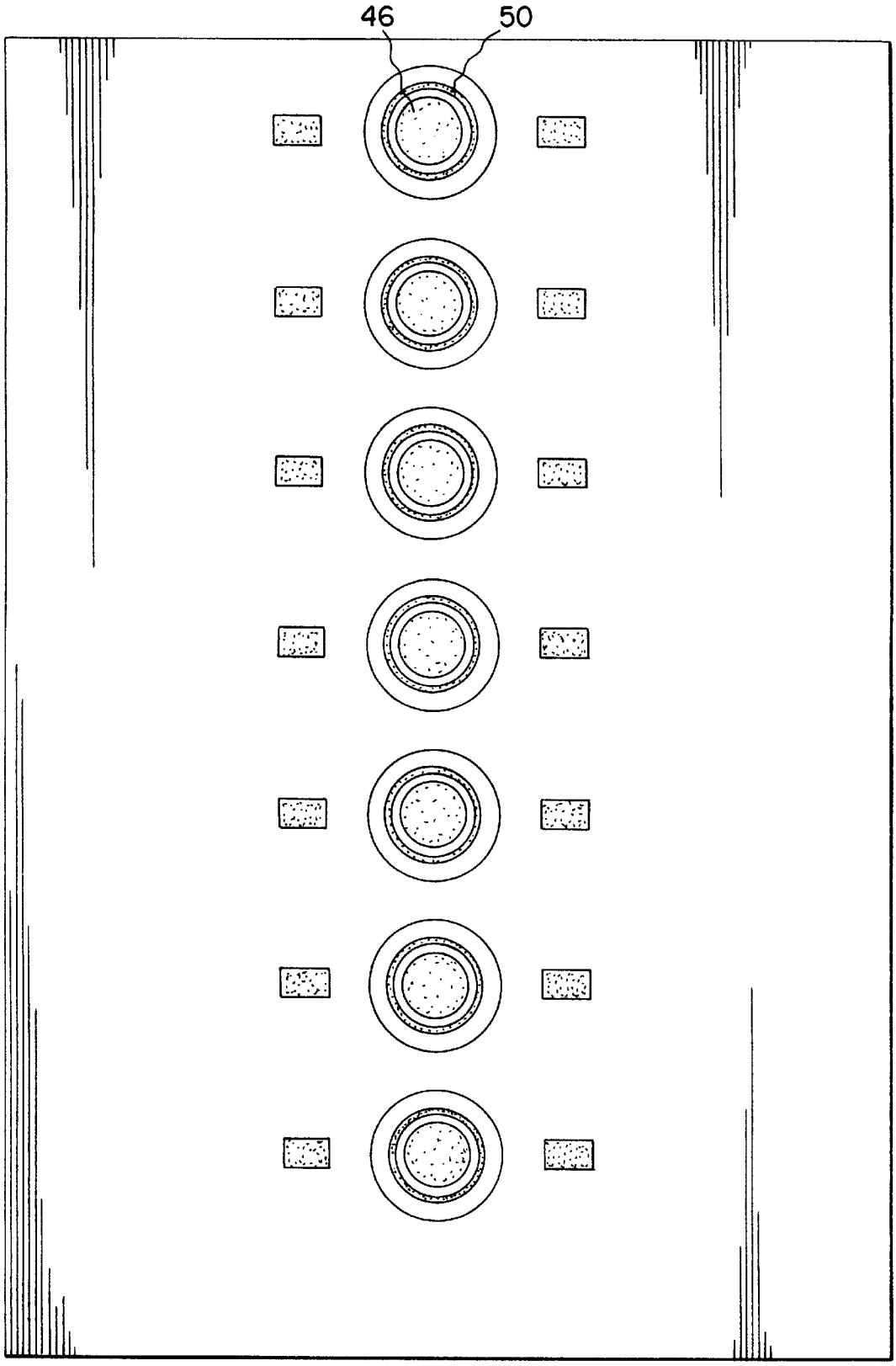
FIG. 6 is an enlarged top view of a small portion of an array of nozzles, together with the metal conductors which communicate electrical energization to the nozzles.

FIG. 6 is an enlarged top view of a small portion of an array of nozzles, together with the metal conductors which communicate electrical energization to the heaters. Annulus heaters 50 located directly under the rim of each nozzle surround the periphery of each nozzle bore. A set of power and ground connections to the heater, from driver circuits as described above and shown in FIG. 3, are also shown in FIG. 6.

Figure 7:
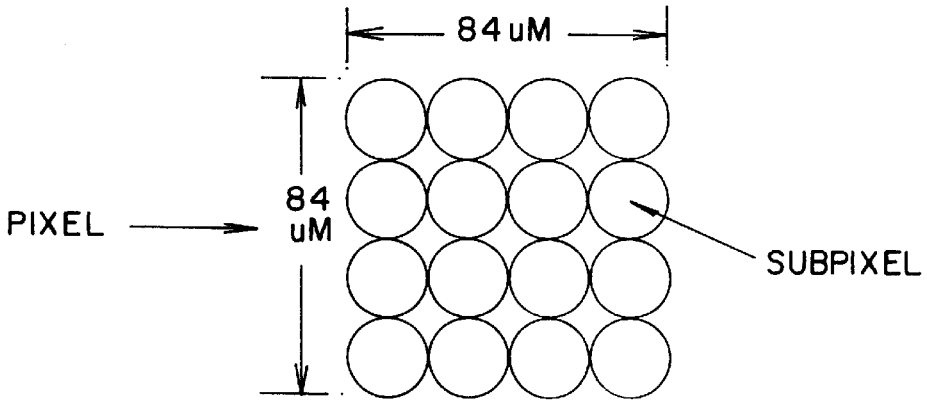
FIG. 7 shows an array of 4×4 subpixel locations.

At a typical viewing distance of about 30 cm, the human eye can resolve no more than about six line pairs/mm. This corresponds to 84 micron line widths, which in turn corresponds to about 300 dots per inch. A 1200 dot per inch ink jet printhead of the type described herewith has 21 micron nozzle-to-nozzle spacing and nozzles of about 10 μm bore diameter which produce droplets that are about 21 microns in diameter. Thus an 84×84 square micron pixel can be formed by an array of 4×4 subpixel locations, as shown in FIG. 7. By placing ink in selected ones of each of the subpixels locations of the 84×84 square micron pixel, sixteen levels of gray are possible.

However, by selectively depositing a plurality of droplets at each of the 4×4 subpixel locations, more than sixteen levels of gray are possible. For example, one may choose to deposit a maximum of seven droplets at each subpixel location. Including the null (zero) level, each 84×84 square micron pixel would then have a possible 128 levels of gray. This assumes an ink density of 1/7 the saturated colorant value.

This mode of operation requires that each stage of the scanners is loaded a maximum of eight times, and that each nozzle is fired a maximum of eight times. Assuming that it takes about 50 μs to release a droplet, the total time to write a 4×6 inch print is about 23 seconds, and the scanner data rate would be about 1.28 MHz. By operating the printer so as to advance the receiver medium one line at a time, and to wait at each line until the shift register is loaded with new data eight times and each nozzle is fired a maximum of seven times, the 128 gray levels for each pixel can be attained.

Figure 8:
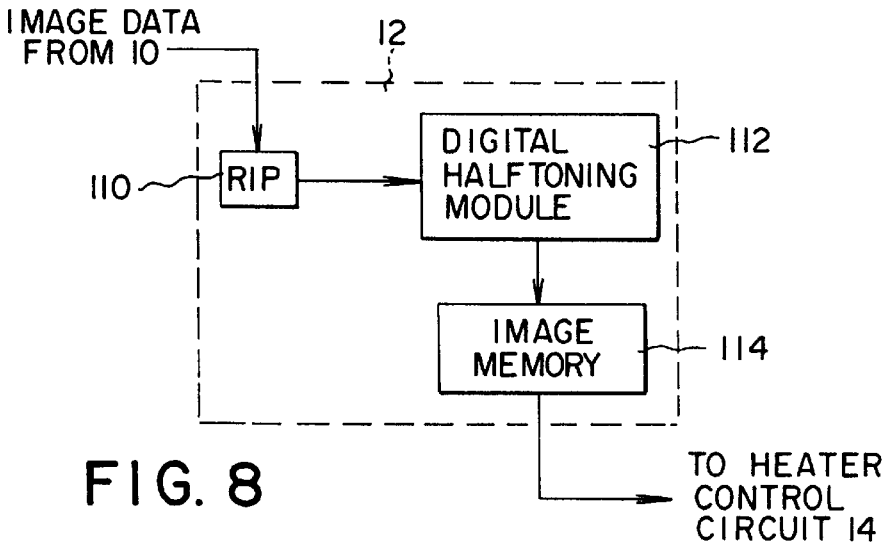
FIG. 8 shows details of portions of an image processing unit of the printing apparatus of FIG. 1(*a*)

FIG. 8 shows details of image processing unit 12 of FIG. 1(*a*). Image data to be printed is received from image source 10 of FIG. 1(*a*) and is converted to a pixel-mapped image by a raster image processor (RIP) 110 in the case of PDL image data, as illustrated, or by other suitable means such as for example by pixel image manipulation in the case of raster image data.

The continuous tone data provided by RIP 110 is halftoned by a digital halftoning module 112. Halftoned bitmap image data is stored in an image memory 114. Depending upon the printer and system configuration, image memory 114 may be a full page memory, or a band memory. Heater control circuit 14 of FIG. 1(*a*) reads data from image memory 114, and in conjunction with the on-chip circuitry, applies time-varying electrical pulses to the nozzle heaters that are part of the printhead.

Figure 9:
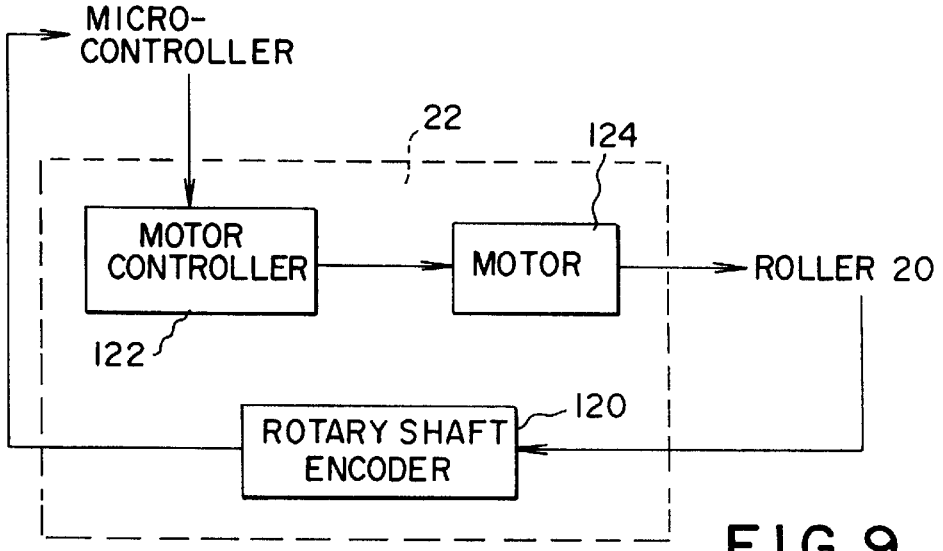
FIG. 9 shows details of a paper transport control of the printing apparatus of FIG. 1(*a*).

FIG. 9 shows details of paper transport control 22 of FIG. 1(*a*). Again, the recording medium is moved relative to the printhead by paper transport roller 20 of FIG. 1(*a*), which is electronically controlled by paper transport control system 22, which in turn is controlled by micro-controller 24. A rotary shaft encoder 120 keeps track of the position of roller 20. Information from encoder 120 is communicated to micro-controller 24, which in turn control the movements of roller 20 via a motor controller 122 and a media transport motor 124. Media transport motor 124 can, for example, be of the type B23 brushless servo motor manufactured by the Industrial Devices Corporation. Motor controller 122 can be of the type B4001 Brushless Servo Drive manufactured by the same company. Encoder 120 can be of the type R-1L rotary shaft encoder manufactured by the Canon Corporation. The recording medium will stop at each line so that the appropriate number of ink drops can be deposited at each location according to the image information in image memory 114.

Theoretically according to the illustrative example, the maximum number of droplets that can land at a single subpixel location is twenty-eight (seven droplets per color, and four colors), in practice the number will be much less because a subpixel that receives twenty-eight droplets will be totally black, and total black can be accomplished equally well with seven black droplets. In another case, cyan, magenta, and yellow droplets are loaded at a subpixel location, but, since cyan, magenta, and yellow in equal amounts produce neutral gray, an equivalent number of black droplets can be substituted; as disclosed in U.S. Pat. No. 5,402,245.

The invention has been described in detail with particular reference to preferred embodiments thereof, but it will be understood that variations and modifications can be effected within the spirit and scope of the invention.

What is claimed is:

1. A process for producing gray scale image pixels from a one-dimensional array of electrical pulse-activated ink jet nozzles generally aligned in a first direction; said process comprising:

applying regular clocked electrical pulses to selected nozzles of the array so that each selected nozzle will deposit ink droplets on a recording medium at a constant drop deposit rate;

inducing intermittent relative movement between the nozzle array and the medium in a second direction generally normal to the first direction; and controlling the relative movement between the nozzle array and the medium to repeatedly pause the relative movement while a plurality of droplets are selectively deposited by each nozzle of the array, whereby a pixel is formed having a gray scale level equal to the number of nozzles in the array multiplied by the number of pauses multiplied by the number of droplets that are selectively deposited by each nozzle during each pause, including zero droplets.

2. A process as set forth in claim 1 wherein nozzle spacing is such, the electrical pulses are applied, and the relative movement is controlled so that photographic quality images having a resolution in the order of six line pairs/mm can be produced with a dynamic range of about 128 levels of gray scale.

3. Ink jet printing apparatus for producing gray scale image pixels on a received recording medium; said apparatus comprising:

a plurality of electrical pulse activated ink-ejecting nozzles forming a one-dimensional array in a first direction;

a plurality of nozzle control circuits adapted to apply regular clocked electrical pulses to selected nozzles of the array so that each selected nozzle will deposit ink droplets on a received recording medium at a constant drop deposit rate;

a transport mechanism adapted to provide relative movement between the nozzle array and the medium in a second direction generally normal to the first direction; and a transport mechanism control system adapted to provide intermittent relative movement between the nozzle array and the medium, and to repeatedly pause the relative movement while a plurality of droplets are selectively deposited by each nozzle of the array, whereby a pixel is formed having a gray scale level equal to the number of nozzles in the array multiplied by the number of pauses multiplied by the number of droplets that are selectively deposited by each nozzle during each pause, including zero droplets.

4. Ink jet printing apparatus as set forth in claim 3, wherein the nozzles:

are spaced apart by a predetermined distance; and form spots that are approximately equal in diameter to the predetermined distance.

5. Ink jet printing apparatus as set forth in claim 4, wherein the nozzles are space about 21 microns apart on centers and form spots of about 21 micron diameter.

6. Ink jet printing apparatus as set forth in claim 5, wherein the electrical pulses are applied, and the relative movement is controlled so that:

there is 21 microns of relative movement between the nozzle array and the medium between movement pauses; and up to seven droplets can be deposited during each pause, whereby photographic quality images having a resolution in the order of six line pairs/mm can be produced with a dynamic range of about 128 levels of gray scale.

* * * * *